United States Patent [19]

Piber

[11] 3,995,132

[45] Nov. 30, 1976

[54] FUNCTION INDICATION MEANS FOR ELECTRIC SWITCHES

[75] Inventor: Earl T. Piber, Oconomowoc, Wis.

[73] Assignee: Cutler-Hammer, Inc., Milwaukee, Wis.

[22] Filed: Aug. 14, 1975

[21] Appl. No.: 604,786

[52] U.S. Cl. ..... 200/315

[51] Int. Cl.[2] ..... H01H 9/16

[58] Field of Search..... 200/308, 314, 315; 16/124 L, DIG. 28

[56] References Cited

UNITED STATES PATENTS 3,885,116 5/1975 Kodaira ..... 200/315

*Primary Examiner*—Herman Hohauser

*Attorney, Agent, or Firm*—Hugh R. Rather; William A. Autio; Michael E. Taken

[57] ABSTRACT

A rocker switch having non-illuminated indicator means comprising a ribbon or sheet member which effectively slides along the interior surface of a rocker cap having a window visually exposing the appropriate indicia on the ribbon as the rocker is pivoted. The ribbon is flexible enough to assume the interior shape of the rocker cap and stiff enough to slide therealong during rocking operation. A window or lens may assume various positions on the rocker cap with appropriate positioning of indicia on the ribbon therebeneath.

14 Claims, 9 Drawing Figures

FUNCTION INDICATION MEANS FOR ELECTRIC SWITCHES

BACKGROUND OF THE INVENTION

Rocker switches having non-illuminated visual indicator means are known in the prior art. However these prior switches have been subject to one or more disadvantages such as complexity of design and high cost. This invention relates to improvements thereover.

SUMMARY OF THE INVENTION

An object of the invention is to provide an improved non-illuminated indicating means for electric switches.

Another object of the invention is to provide indicating means of the aforementioned character providing function information in a rocker switch.

Another object of the invention is to provide indicating means of the aforementioned character capable of multi-positional window placement for visual exposition of indicia.

Another object of the invention is to provide a simple and economical indicating means of the aforementioned type.

DESCRIPTION OF THE PREFERRED EMBODIMENT

Figure 1:
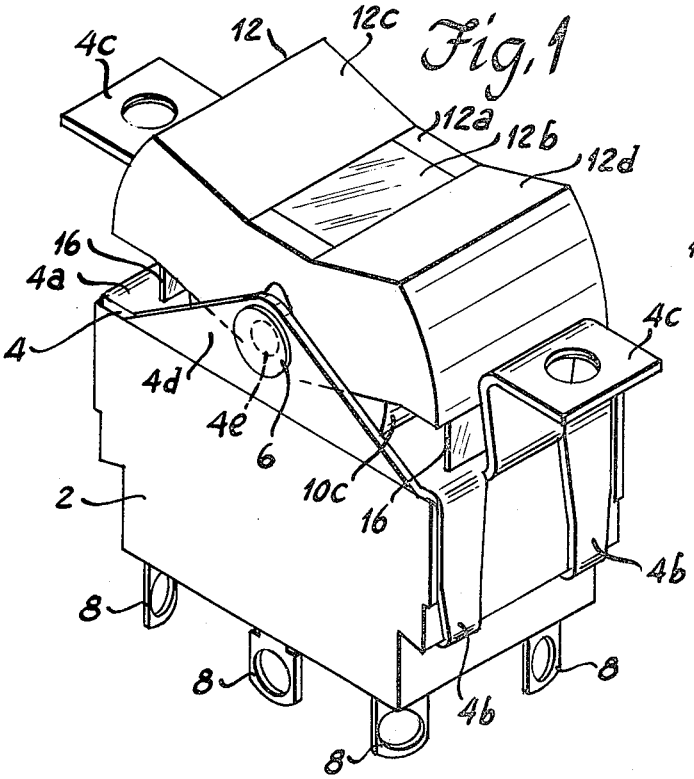
FIG. 1 is an isometric view of a rocker switch constructed in accordance with the invention.

Referring to the drawings, the electric switch includes a casing consisting of a box-like insulated switch base 2 and a punched and stamped sheet metal switch frame 4. Switch frame 4 is provided with a cover portion 4*a* overlying and substantially closing the cavity in base 2. The switch frame also has portions 4*b* bent downwardly to provide securement of the frame to base 2. Upwardly and outwardly bent portions 4*c* of the switch frame provide mounting brackets, and generally triangular portions 4*d* bent upwardly and in parallel with the side walls of base 2 have aligned apertures 4*e* to accommodate the end portions of a pivot pin 6.

Figure 3:
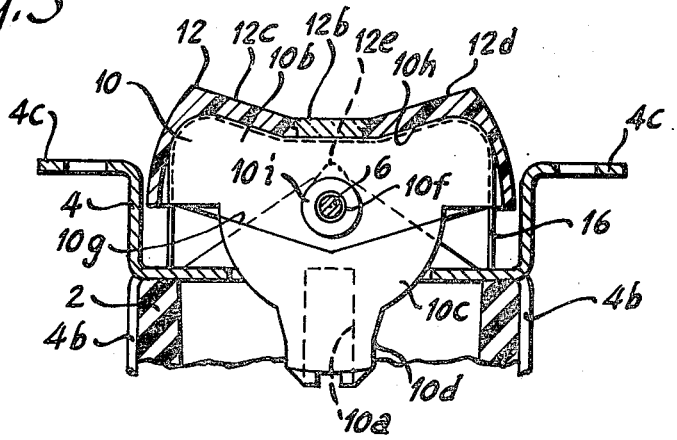
FIG. 3 is a cross-sectional view taken along line 3—3 of FIG. 2.

The switch contacts and operating mechanism contained within base 2 form no part of the present invention, so disclosure and description of the same is omitted for the sake of clarity. As will be appreciated switch contacts and operating mechanisms that can be used with the present invention can take various forms with one preferred form being like that described in U.S. Pat. No. 2,927,983. It may be assumed that stationary contacts within the base 2 have electrical connection with terminals 8 which extend downwardly from the lower surface of the base. As best shown in FIG. 3, a rocker type operator 10 has an integral depending shank portion 10*d* which extends downwardly within the cavity of base 2 and carries an elongated recess 10*a* in which may be assumed to be a spring biased contactor operating lever (not shown) of the type shown in the aforementioned patent.

Figure 9:
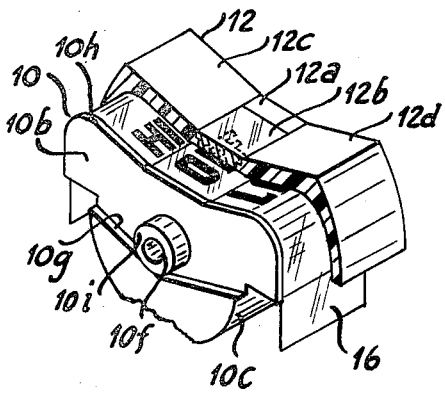
FIG. 9 is an isometric view, partially cut away, of the rocker, indicia bearing ribbon and rocker cap.

As shown in FIG. 9, a detachable snap-on rocker cap 12 fits over rocker 10 in a shell-like manner and is rigidly mounted thereon, as will be described more fully hereinafter. As seen in FIG. 3, rocker 10 comprises a generally T-shaped integral member having a top portion 10*b*, a generally semi-circular intermediate stem portion 10*c*, and an integral depending shank portion 10*d*. The top portion 10*b* is formed with a central flat surface, two inclined flat surfaces extending oppositely therefrom at equal obtuse angles, and two curved surfaces extending from said inclined flat surfaces. The semicircular portion 10*c* is provided with a bushing-like protrusion 10*i* and a pivot aperture 10*f* of circular cross-section extending therethrough. Pivot pin 6 extends through the aligned apertures 4*e* and 10*f* and through corresponding apertures on the opposite side of the rocker and frame (not shown) to provide pivotal support of the rocker, widened ends of the pin acting as retainers therefor.

As shown in FIG. 9, the rocker further has a shallow V-shaped ledge 10*g* formed on each side of the semicircular stem portion 10*c* below the apertures 10*f*, and a raised shoulder 10*h* on each side of and running the entire length of the top portion 10*b*.

Figure 5:
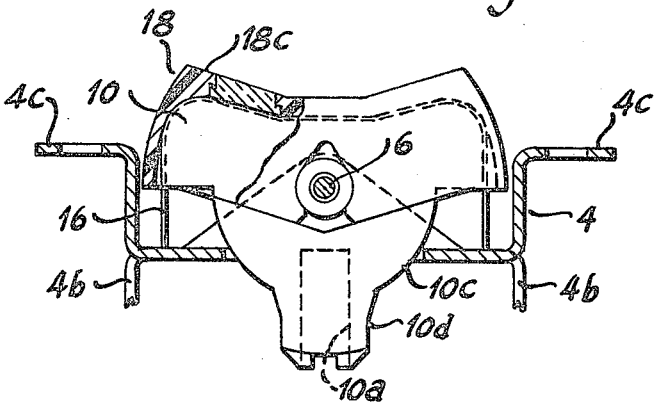
FIG. 5 is a side elevational view, partially cut away, of the switch of FIG. 1, but having a modified window placement.

Rocker cap 12 has an interior contour complementally conformed to the shape of the top portion 10*b* of the rocker, and an exterior having a central flat surface 12*a* with a transparent window 12*b* therein and two opaque inclined flat surfaces 12*c* and 12*d* extending oppositely therefrom at equal obtuse angles. As seen in FIGS. 3 and 5, the rocker cap has a downwardly opening slot 12*e* on each side thereof for engaging in a snap-on manner the bushing-like protrusion 10*i* around pivot pin 6. The lower edges of the rocker cap are seated by and stopped against the ledges 10*g* of the rocker and the interior of the rocker cap is seated by and stopped against the shoulders 10*h* of the rocker to provide a small clearance gap or passageway between the top surfaces of rocker and the top interior surfaces of the rocker cap and to provide unified rocking action of the rocker cap and rocker.

A thin acetate ribbon, strip or sheet 16, which in one preferred form is approximately 0.010 inch thick, is slidably received within the passageway. The ribbon may also be formed of nylon, mylar, kapton or any other comparable semi-plastic semi-flexible material or the like. This ribbon extends up from the cover portion 4*a* of the frame, then into the passageway passing beneath the transparent window in the rocker cap, and then down to the cover portion again, as seen in FIG. 3. As seen in FIGS. 1 and 9, the ribbon must be flexible enough to substantially assume the shape of the interior contour of the rocker cap, yet stiff enough to slide therealong as the rocker is pivoted with the cover portion 4*a* of the frame acting as a stop therefore. The ribbon must also have a low coefficient of friction to enable it to slide through the passageway.

Figure 2:
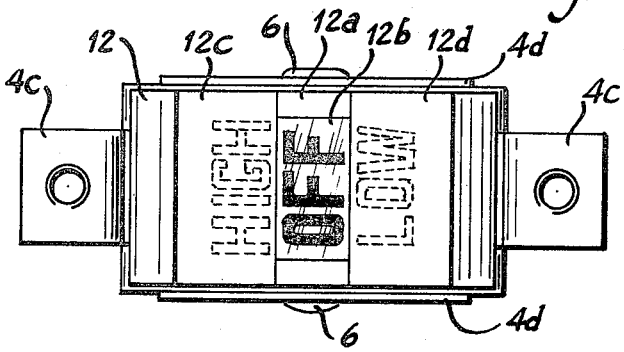
FIG. 2 is a top view of the switch shown in FIG. 1.
Figure 4:
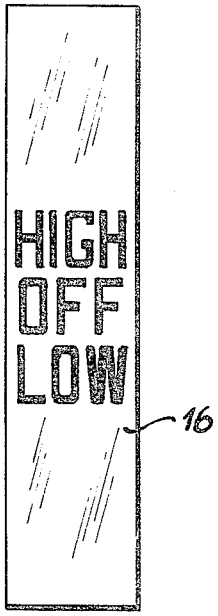
FIG. 4 is a view of an indicia bearing ribbon in disassembled condition.

As seen in FIG. 4, the ribbon is marked with appropriate indicia for providing function information. As seen in FIGS. 2 and 9, with the rocker cap in its center position, the transparent window will visually expose the indicia "OFF". Right and left rocking of the rocker cap and rocker will cause visual exposition of "LOW" and "High", respectively.

As seen in FIG. 5, a window may also be placed on inclined flat surface 18*c* of rocker cap 18. During molding of the rocker cap, the window opening is formed from below in order to assure a flush surface for the ribbon to slide along after the window is placed therein. With the window in the center, as shown in FIG. 3, the opening may be formed from above because the ribbon will bow out slightly from the center interior surface of the rocker cap and hence the bottom of the window need not be perfectly flush with the interior surface of the rocker cap.

Figure 6:
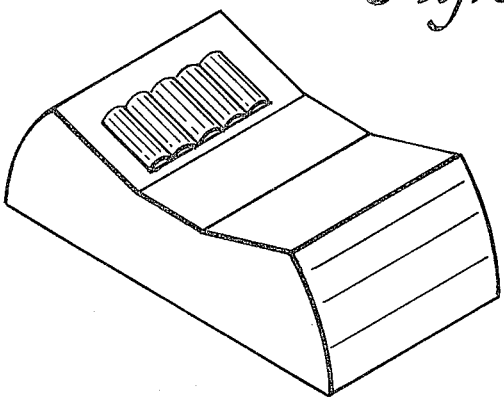
FIG. 6 is an isometric view of a rocker cap showing a window placement therein.
Figure 7:
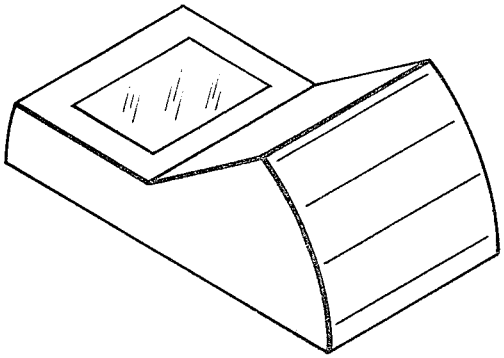
FIG. 7 is a view like FIG. 6 but showing another window placement therein.
Figure 8:
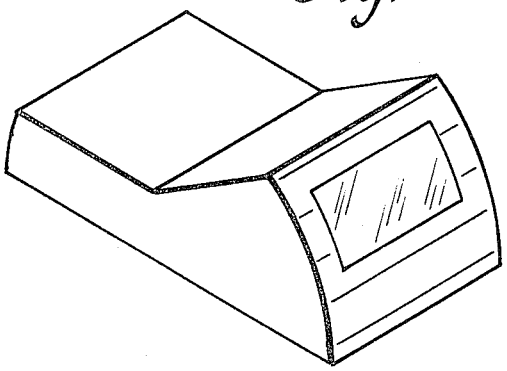
FIG. 8 is a view like FIG. 7 but showing yet another window placement therein.

FIG. 6 shows an alternate embodiment wherein a refractive lense may be used. FIGS. 7 and 8 show alternate rocker caps and window placements therein.

It is to be appreciated that the invention encompasses many variations of rocker caps, windows, window placements, ribbons and indicia, all within the scope of the present invention.

It is further to be appreciated many types of operators other than rockers and rocker caps may be used, for example, any type of movable operator having a window to expose a ribbon or sheet constrained against moving with the operator will provide the conceived means of indication.

I claim:

1. An electric switch having function indication means comprising a sheet-like elongated ribbon having stationary ends and slidably extending longitudinally through a movable operator having a window, said ribbon being in continuous contiguous facing relationship with said window throughout movement of said operator, said ribbon sliding tangentially through said operator in response to movement of said operator, said window visually exposing different portions of said ribbon during movement of said operator as said window slides longitudinally along said ribbon.

2. In an electric switch, the combination comprising:

a housing;

operator means having a window and mounted to said housing for movement relative thereto for effecting switching operations, said operator means having a thin passageway formed therethrough generally along an inner perimeter of an external portion thereof and passing beneath said window; and a sheet-like elongated laterally flexible ribbon deflectably and slidably extending longitudinally through said passageway and constrained at its ends against longitudinal movement by said housing so that upon movement of said operator means said ribbon deflectingly slides tangentially through said passageway in continuous contiguous facing relationship with said window throughout said operator movement whereby different portions of said ribbon will be visually exposed by said window as said window slides longitudinally along said ribbon.

3. The combination according to claim 2 wherein said operator means comprises an operating member and a cap member mounted to and spaced from said operating member to afford said passageway therebetween.

4. The combination according to claim 2 wherein said ribbon is formed of a material and has a thickness such that it is sufficiently flexible to contour to the shape of said passageway but also sufficiently rigid to slide therethrough during movement of said operator means.

5. In a rocker switch, the combination comprising a sheet-like elongated laterally flexible ribbon having stationary ends and deflectably and slidably extending longitudinally through a rockable operator having a window, said ribbon being in continuous contiguous facing relationship with said window throughout rocking of said operator, said ribbon deflectingly sliding tangentially through said operator in response to rocking of said operator, said window visually exposing different portions of said ribbon during rocking of said operator whereby to afford operator position indication as said window slides longitudinally along said ribbon.

6. In a rocker switch, the combination comprising:

a housing;

operator means having a window and pivotally mounted to said housing for effecting switching operations, said operator means having a thin passageway formed therethrough generally along an inner perimeter of an external portion thereof and passing beneath said window; and a sheet-like elongated laterally flexible ribbon deflectably and slidably extending longitudinally through said passageway and constrained at its ends against longitudinal movement by said housing so that upon pivoting of said operator means said ribbon deflectingly slides tangentially through said passageway in continuous contiguous facing relationship with said window throughout said pivoting whereby different portions of said ribbon will be visually exposed by said window as said window slides longitudinally along said ribbon.

7. In a rocker switch, the combination comprising:

a housing;

a rocker pivotally mounted to said housing for effecting switching operations;

a shell-like cap having a window and overlying said rocker, said cap having an inner perimeter surface complementally conformed to said rocker;

means mounting said cap for pivotal movement relative to said housing in unison with said rocker and spacing said cap from said rocker whereby to afford a thin passageway between said rocker and said cap along said inner perimeter; and a sheet-like elongated laterally flexible ribbon deflectably and slidably extending longitudinally through said passageway and constrained at its ends against longitudinal movement by said housing so that upon rocking of said rocker and said cap said ribbon deflectingly slides tangentially through said passageway in continuous contiguous facing relationship with said window throughout said rocking whereby different portions of said ribbon will be visually exposed by said window as said window slides longitudinally along said ribbon.

8. The combination according to claim 7 wherein said ribbon is formed of a material and has a thickness such that it is sufficiently flexible to contour to the shape of said passageway, but also sufficiently rigid to slide therethrough during rocking of said rocker and said cap.

9. The combination according to claim 7 wherein said mounting means comprises shoulders and ledges formed on said rocker for seating said cap.

10. The combination according to claim 9 wherein said mounting means further comprises detent means formed in said cap and said rocker for pivotally mounting said cap to said housing.

11. An electric switch comprising:

a housing;

contact means mounted in said housing;

operator means pivotally mounted to said housing for actuating said contact means and including a rocker button outer portion having a thin passageway extending therethrough about the pivotal axis of said operator means to form an inner perimeter generally parallel to and coextensive with the outer perimeter of said rocker button outer portion;

a window in said rocker button outer portion visually exposing part of said passageway;

a sheet-like elongated laterally flexible ribbon extending longitudinally through said passageway and having rocker position indicating means thereon and having both of its ends constrained by said housing against longitudinal movement while allowing deflection of its intermediate portion, said ribbon generally conforming to the shape of said passageway such that in response to pivoting of said operator means said ribbon deflectingly slides through said passageway tangentially along said inner perimeter to expose different portions of said indicating means through said window as said ribbon slides therebeneath, said ribbon and said window being in continuous contiguous facing relationship throughout pivoting of said operator means as said window slides longitudinally along said ribbon.

12. The switch according to claim 11 wherein said operator means comprises a rocker actuator pivotally mounted to said housing for actuating said contact means and wherein said rocker button outer portion comprises a portion of said rocker actuator external of said housing and a shell-like cap overlying and complementally conformed to said external portion of said rocker actuator and spaced therefrom to form said passageway therebetween.

13. The switch according to claim 11 wherein said ribbon has a width extending parallel to said pivotal axis, and wherein both ends of said ribbon extend beyond said passageway parallel to each other and stopped against said housing, and wherein said ribbon is formed of a material and has a thickness such that it is sufficiently flexible to contour to the shape of said passageway and also sufficiently rigid to slide therethrough during pivoting of said operator without buckling in that portion of said ribbon extending beyond said passageway.

14. The switch according to claim 11 wherein said rocker button outer portion has a shallow generally M-shaped outer perimeter about said pivotal axis having a pair of oppositely inclined surfaces disposed on opposite sides of said pivotal axis and wherein said passageway and inner perimeter have a shallow rounded generally M-shaped configuration.

* * * * *